US008771112B2

(12) United States Patent
Sanford

(10) Patent No.: US 8,771,112 B2
(45) **Date of Patent: *Jul. 8, 2014**

(54) BROADHEAD

(71) Applicant: Chris G. Sanford, Billings, MT (US)

(72) Inventor: Chris G. Sanford, Billings, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/664,196

(22) Filed: Oct. 30, 2012

(65) Prior Publication Data

US 2013/0123052 A1 May 16, 2013

Related U.S. Application Data

(60) Continuation of application No. 13/363,284, filed on Jan. 31, 2012, now Pat. No. 8,313,399, which is a continuation-in-part of application No. 12/590,393, filed on Nov. 5, 2009, now Pat. No. 8,105,187, which is a continuation-in-part of application No. 11/810,285, filed on Jun. 5, 2007, now Pat. No. 8,007,382, said application No. 13/363,284 is a continuation-in-part of application No. 13/374,340, filed on Dec. 23, 2011, now Pat. No. 8,287,407, which is a division of application No. 12/590,393, which is a continuation-in-part of application No. 11/810,285, said application No. 13/363,284 is a continuation-in-part of application No. 13/374,549, filed on Jan. 3, 2012, now Pat. No. 8,393,983, which is a continuation-in-part of application No. 12/590,393, which is a continuation-in-part of application No. 11/810,285.

(51) Int. Cl.
*F42B 6/08* (2006.01)

(52) U.S. Cl.
CPC ..... *F42B 6/08* (2013.01)
USPC ..... 473/583

(58) Field of Classification Search
USPC ..... 473/583, 584
See application file for complete search history.

(56) References Cited

U.S. PATENT DOCUMENTS

| | | | |
|---|---|---|---|
| 2,859,970 | A | 11/1958 | Doonan |
| 2,993,697 | A | 7/1961 | Urban |
| 3,138,383 | A | 6/1964 | Mckinzie |
| 3,738,657 | A | 6/1973 | Cox |
| 3,756,600 | A | 9/1973 | Maleski |
| 4,166,619 | A | 9/1979 | Bergmann et al. |
| 4,405,133 | A | 9/1983 | Cartwright, Jr. |
| 4,973,060 | A | 11/1990 | Herzing |
| 4,976,443 | A | 12/1990 | DeLucia |
| 4,998,738 | A | 3/1991 | Puckett |
| 5,066,021 | A | 11/1991 | DeLucia |
| 5,082,292 | A | 1/1992 | Puckett et al. |
| 5,102,147 | A | 4/1992 | Szeluga |
| 5,112,063 | A | 5/1992 | Puckett |
| 5,178,398 | A | 1/1993 | Eddy |

(Continued)

*Primary Examiner* — John Ricci
(74) *Attorney, Agent, or Firm* — Becker Patent Law, LLC

(57) ABSTRACT

An arrow broadhead having a pair of cutting blades held in a retracted position during arrow flight and extending outwardly in an expanded position upon arrow contact. The subject broadhead includes a pair of pivot arms or sliding arm received in an elongated groove in a cutting blade housing body. The pivot arms or sliding arm are attached to one end of the cutting blades. At least a portion of the cutting blades are folded into the groove during arrow flight. Upon target contact, the pivot arms or sliding arm pivot the cutting blades outwardly from opposite sides of the groove into an expanded position for increased cutting and penetration in the target.

20 Claims, 8 Drawing Sheets

(56) References Cited

U.S. PATENT DOCUMENTS

| | | | |
|---|---|---|---|
| 5,178,399 | A | 1/1993 | Garoutte |
| 5,322,297 | A | 6/1994 | Smith |
| 5,458,341 | A | 10/1995 | Forrest et al. |
| 5,472,213 | A | 12/1995 | Dudley |
| 5,564,713 | A | 10/1996 | Mizek et al. |
| 5,803,844 | A | 9/1998 | Anderson |
| 5,857,930 | A | 1/1999 | Troncoso |
| 5,879,252 | A | 3/1999 | Johnson |
| 5,941,784 | A | 8/1999 | Mizek |
| 6,165,086 | A | 12/2000 | Liechty, II |
| 6,200,237 | B1 | 3/2001 | Barrie |
| 6,258,000 | B1 | 7/2001 | Liechty, II |
| 6,270,435 | B1 | 8/2001 | Sodaro |
| 6,287,224 | B1 | 9/2001 | Liechty, II |
| 6,306,053 | B1 | 10/2001 | Liechty, II |
| 6,322,464 | B1 | 11/2001 | Sestak |
| 6,428,434 | B1 | 8/2002 | Liechty, II |
| 6,517,454 | B2 | 2/2003 | Barrie et al. |
| 6,554,727 | B1 | 4/2003 | Armstrong et al. |
| 6,626,776 | B2 | 9/2003 | Barrie et al. |
| 6,669,586 | B2 | 12/2003 | Barrie et al. |
| 6,755,758 | B2 | 6/2004 | Liechty, II |
| 6,758,774 | B2 | 7/2004 | Liechty, II |
| 6,910,979 | B2 | 6/2005 | Barrie et al. |
| 6,935,976 | B1 | 8/2005 | Grace et al. |
| 6,942,588 | B2 | 9/2005 | Barrie |
| 7,037,222 | B2 | 5/2006 | Mizek et al. |
| 7,226,375 | B1 | 6/2007 | Sanford |
| 7,232,390 | B2 | 6/2007 | Mizek et al. |
| 7,234,220 | B1 | 6/2007 | Grace, Jr. |
| 7,771,298 | B2 | 8/2010 | Pulkrabek |
| 7,905,802 | B2 | 3/2011 | Erhard |
| 7,951,024 | B2 | 5/2011 | Mizek |
| 8,007,382 | B1 | 8/2011 | Sanford |
| 8,105,187 | B1 | 1/2012 | Sanford |
| 8,197,367 | B2 | 6/2012 | Pulkrabek et al. |
| 8,210,972 | B2 | 7/2012 | Adams et al. |
| 8,313,399 | B2 * | 11/2012 | Sanford ..... 473/583 |
| 8,328,667 | B2 | 12/2012 | Adams et al. |
| 8,398,510 | B1 | 3/2013 | Mizek et al. |
| RE44,144 | E | 4/2013 | Barrie et al. |
| 8,449,415 | B2 | 5/2013 | Grace |
| 8,469,842 | B2 | 6/2013 | Mizek et al. |
| 8,469,843 | B2 | 6/2013 | Mizek et al. |
| 8,512,179 | B2 | 8/2013 | Pulkrabek et al. |
| 8,545,349 | B1 | 10/2013 | Budris et al. |
| 2002/0055404 | A1 | 5/2002 | Liechty, II |
| 2002/0065155 | A1 | 5/2002 | Liechty, II |
| 2003/0073525 | A1 | 4/2003 | Liechty, II |
| 2008/0045363 | A1 | 2/2008 | Pulkrabek |
| 2009/0203477 | A1 | 8/2009 | Mizek et al. |
| 2010/0113196 | A1 | 5/2010 | Jones |
| 2013/0190112 | A1 | 7/2013 | Pederson |

* cited by examiner

BROADHEAD

CROSS-REFERENCE TO RELATED PATENT APPLICATIONS

This application is a continuation of U.S. application Ser. No. 13/363,284, filed Jan. 31, 2012, which is a continuation-in-part of U.S. application Ser. No. 12/590,393, filed Nov. 5, 2009, now U.S. Pat. No. 8,105,187, which is a continuation-in-part of U.S. application Ser. No. 11/810,285, filed Jun. 5, 2007, now U.S. Pat. No. 8,007,382. U.S. application Ser. No. 13/363,284 is also a continuation-in-part of U.S. application Ser. No. 13/374,549, filed Jan. 3, 2012, which is a continuation-in-part of U.S. application Ser. No. 12/590,393, filed Nov. 5, 2009, now U.S. Pat. No. 8,105,187, which is a continuation-in-part of U.S. application Ser. No. 11/810,285, filed Jun. 5, 2007, now U.S. Pat. No. 8,007,382. U.S. application Ser. No. 13/363,284 is also a continuation-in-part of U.S. application Ser. No. 13/374,340, filed Dec. 23, 2011, now U.S. Pat. No. 8,287,407 which is a divisional of U.S. application Ser. No. 12/590,393, filed Nov. 5, 2009, now U.S. Pat. No. 8,105,187, which is a continuation-in-part of U.S. application Ser. No. 11/810,285, filed Jun. 5, 2007, now U.S. Pat. No. 8,007,382. All of these applications are incorporated herein by reference in their entireties.

BACKGROUND

The present disclosure relates broadly to an arrow broadhead with retracted cutting blades that pivot outwardly into an expanded position upon target contact and more particularly, but not by way of limitation, to an arrow broadhead having a cutting blade housing body with an elongated groove extending along a portion of a length of the housing body. The groove is used to receive a pair of pivot arms or a sliding arm attached to a pair of cutting blades. The cutting blades are received in opposite sides of the groove when the broadhead is in a retracted position during arrow flight. Upon target contact, the pivot arms or sliding arm pivot the cutting blades outwardly from the sides of the groove into an expanded position for maximum cutting and target penetration.

SUMMARY

In view of the foregoing, various embodiments provide a broadhead with a pair of cutting blades in a retracted position in a groove in a cutting blade housing body during arrow flight, hold the cutting blades in an expanded, locked position during target contact, and then allow the cutting blades to be folded forward for ease in release, when the broadhead is pulled outwardly from the target, making it a non-barbed broadhead design.

Other embodiments illustrate how an arrow broadhead housing can include an elongated groove and bore hole for receiving a sliding arm shaft or sliding arm plate with at least two attached cutting blades and a removable tip, that is separate from a sliding arm shaft as disclosed in U.S. Pat. Nos. 8,007,382, and 8,105,187 by the subject inventor. The separate, removable tip can be attached to a top portion of the housing body, thereby allowing the sliding arm shaft or sliding arm plate to be contained in the sliding arm housing. This feature allows the cutting blades to pivot forward for easy target removal and for making it a non-barbed broadhead design.

Still other embodiments relate to using the broadhead's forward inertia and holding the cutting blades in the groove in the cutting blade housing body to almost instantaneously upon target contact move the cutting blades into a fully expanded and locked position. The forward inertia of the arrow broadhead and the extension of the blades provide for an ultimate cutting and tissue damage to the intended target. This feature results in larger entry and exit holes in the target, better blood trails and higher game recovery.

The subject arrow broadhead includes a pair of pivot arms or sliding arm received in an elongated groove in a cutting blade housing body. The pivot arms or sliding arm are attached to one end of a pair of cutting blades. The cutting blades are folded into the groove during arrow flight. Upon target contact, the pivot arms or sliding arm pivot the cutting blades outwardly from opposite sides of the groove into an expanded position for increased cutting and penetration in the target. The sliding arm can be in a form of a sliding arm shaft or a sliding arm plate having different shapes and different combinations.

The various features of the embodiments disclosed herein will become apparent to those familiar with the use of arrow broadheads for hunting and target shooting when reviewing the following detailed description, showing novel construction, combination, and elements as described, and more particularly defined by the claims, it being understood that changes in the embodiments to the disclosed invention are meant to be included as coming within the scope of the claims.

BRIEF DESCRIPTION OF THE DRAWINGS

The accompanying drawings illustrate various embodiments for arrow broadheads in which.

DETAILED DESCRIPTION OF EXEMPLARY EMBODIMENTS

Figure 1:
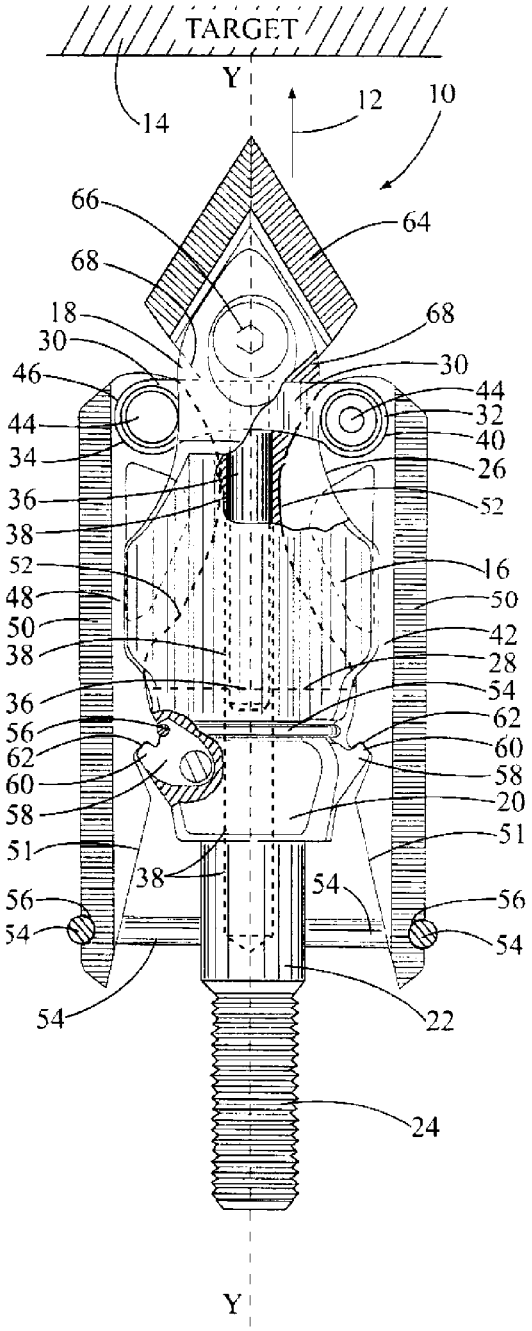
FIG. 1 is a front view of the arrow broadhead with a pair of cutting blades attached to opposite ends of a sliding pivot arm. The pivot arm is received inside a top portion of an elongated groove in the cutting blade housing body. The sliding pivot arm is used to pivot the cutting blades from a retracted position to an expanded position, as shown in FIG. 3.

In FIG. 1, a front view of the subject arrow broadhead is shown, having general reference numeral 10. The broadhead 10 is illustrated in flight, as indicated by arrow 12, prior to contacting a target 14. The broadhead 10 includes a cutting blade housing body 16 having a length disposed along a vertical center line Y-Y, shown in dashed lines. The housing body 16 includes a top portion 18, a middle portion 20 and a bottom portion 22. Extending downwardly from the bottom portion 22 is a threaded end 24 used for attaching the broadhead 10 to a hollow arrow shaft with insert. The arrow shaft and insert aren't shown in the drawings.

The housing body 16 is characterized by having an elongated groove 26 extending from the top portion 18 downwardly to the bottom portion 22 and ending in a groove bottom 28. The groove bottom 28 is shown in dashed lines.

In this embodiment, the broadhead 10 includes a sliding arm shaft 36. The shaft 36 helps provide alignment and is received in a shaft bore hole 38 in the housing body 16. Also shown is a sliding arm extension 30, having a first end 32 and a second end 34. It should be noted that the sliding arm extension 30 can be various sizes and shapes. The sliding arm extension 30 is received through the groove 26 in the top portion 18 of the housing body 16, with the first and second ends 32 and 34 extending outwardly from opposite sides of the housing body 16. In this drawing, part of the top portion 18 has been cutaway to illustrate the sliding arm extension 30 received in the groove 26.

Also shown in this drawing is the first end 32 of the sliding arm extension 30 attached to a first cutting blade 42 and the second end 34 of the sliding arm extension 30 attached to a second cutting blade 48 using a rivet 44, a screw or similar fastener. Also, the cutting blades 42 and 48 can be attached directly to the sliding arm shaft 36, thereby eliminating the first and second ends 32 and 34 of the sliding arm extension 30. The cutting blades 42 and 48 are shown extending downwardly in a substantial vertical orientation. The groove 26 has sufficient width for receiving the sliding arm extension 30 and the attached offset cutting blades 42 and 48. The cutting blades 42 and 48 include an outer beveled, cutting edge 50, an inside edge 51, and an inner cam surface 52. A portion of the cam surface 52 engages opposite ends of the groove bottom 28, shown in dashed lines.

Figure 2:
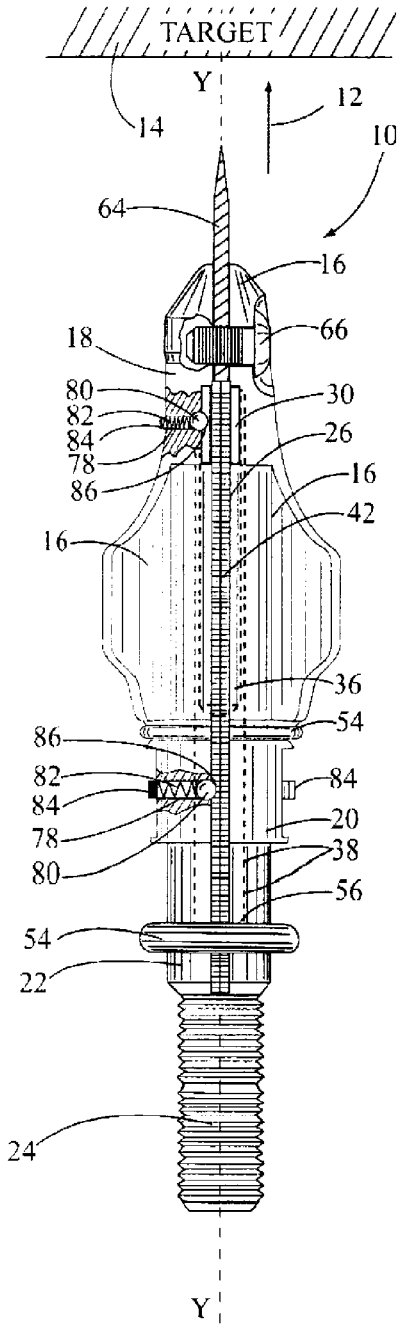
FIG. 2 is a side view of the arrow broadhead, as shown in FIG. 1.
Figure 3:
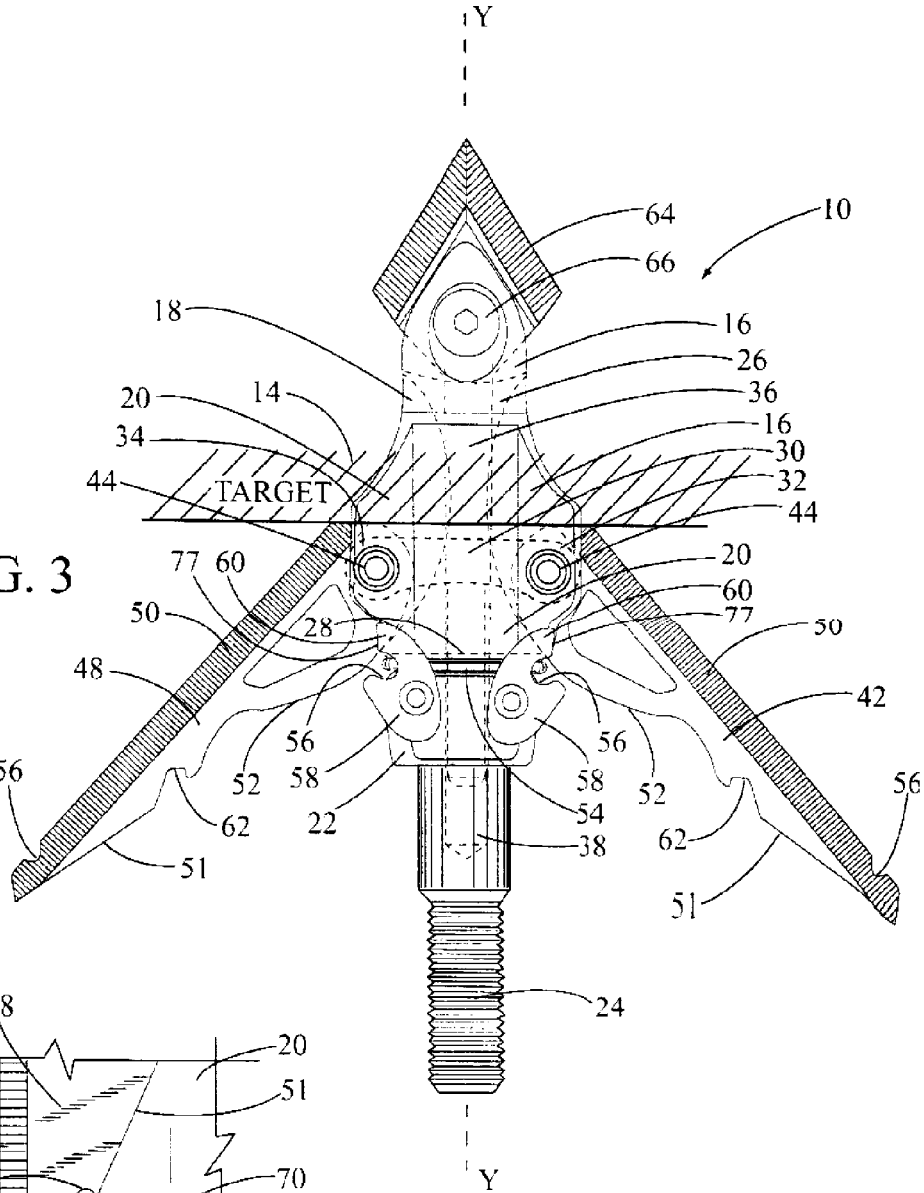
FIG. 3 is another front view of the broadhead, as shown in FIG. 1, with the sliding pivot arm moved from the top portion of the groove downwardly to a bottom of the groove upon target contact. The sliding arm has now pivoted the cutting blades outwardly into an expanded position for maximum cutting and target penetration.

While FIGS. 1-3 illustrate the sliding arm shaft 36 with the sliding arm extension 30 received in the groove 26, it should be mentioned that the upper portion of the cutting blades 42 and 48 can be attached directly to the top of the sliding arm shaft 36 in the groove 26, thus eliminating the sliding arm extension 30. This embodiment of the arrow broadhead 10, without using the sliding arm extension 30, will work in the same manner as described in these drawings.

The cutting blades 42 and 48 can be held in a retracted position during arrow flight using an "O" ring 54, a rubber band and the like received in a "O" ring notch 56 in the outside or cutting edge 50 of the cutting blades 42 and 48. Upon target contact, the "O" ring 54 is released from the notch 56. Also, the notch 56, with the "O" ring 54, can be in the inside edge 51 of the blades.

Also, the "O" ring 54 can be received in another "O" ring notch 56 in the top portion 18 of the housing body 16 and held therein by an "O" ring hook 57 in the top of the cutting blades 42 and 48. Upon target contact, the "O" ring 54 is released from the "O" ring hook 57 allowing the cutting blades 42 and 48 to move downwardly and into an expanded position.

Further and as another example, a pair of cam levers 58 can be attached to opposite side the middle portion 20 of the housing body 16. The cam levers 58 include an "O" ring notch 56 for receiving an "O" ring 54. The levers also include a blade hook 60. The blade hook 60 is received in a blade notch 62 in the inside edge 51 of the blades 42 and 48. It should be noted the blade hook 60 can be in front or behind the "O" ring 54. When the broadhead 10 contacts the target 14, the "O" ring 54 is stretched and then pulled back into the "O" ring notch 56 as the blade hook 60 rotates away from the blade notch 62, thereby releasing the blades 42 and 48 to expand into an extended position, as shown in FIG. 3.

Figure 1A:
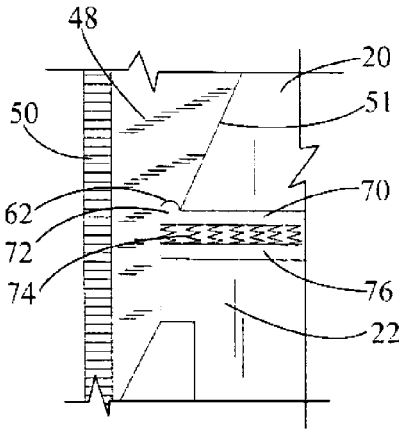
FIG. 1A is an enlarged view of a portion of a spring washer or magnetic washer mounted on the housing body for holding the cutting blades in a retracted position during arrow flight.

In FIG. 1A, still another example of a cutting blade retraction system is shown for holding the cutting blades 42 and 48 in a retracted position during arrow flight. In this example, a portion of the second cutting blade 48 is shown with a hook notch 62 in the inside edge 51 of the blade. A ring washer 70 with an upwardly extending ring 72 therearound is mounted on top of a spring washer 74 and a back washer 76. The washers 70, 74 and 76 are mounted around the middle portion 20 of the housing body 16. During arrow flight, the spring washer 74 biases a portion of the ring 72 in the downwardly extending notch 62, thus holding the blade in a retracted position. Upon target contact, the spring washer 74 is compressed and the ring 72 releases the cutting blade to expand outwardly into a extended position. Also, it should be noted that this cutting blade retraction system can also be turned upside down with the ring washer 70 engaging an upwardly extending notch 62 in the cutting blade. Further, it should be noted that the ring washer 70 can also be magnetized for holding the cutting blades in a retracted position and without the use of the spring washer 74 and the back washer 76.

From the above discussion of different types of cutting blades and sliding arms having retaining devices, it can be appreciated that other examples of lateral spring plungers, push-fit plungers, threaded ball plungers, ball plungers with coil spring mounted balls or buttons and ball spring blade retaining devices, metal and plastic "O" rings, different types of washer, combinations of "O" rings and washer, and similar retraction devices can be used equally well and attached to the housing body 16 for engaging and holding the cutting blades and the sliding arm in place during arrow flight and prior to target contact.

Referring back to FIG. 1, the broadhead 10 includes a removable, pointed blade tip 64 mounted in the top of the groove 26 in the top portion 18 of the housing body 16. This feature of the blade tip 64 being removable allows the sliding arm to be received in the groove prior to attaching the blade tip. The blade tip 64 is secured to the top portion 18 using a threaded screw 66 or similar fastener. The blade tip 64 extends outwardly and upwardly from the housing body 16 and obviously first contacts the target 14 during arrow flight. The blade tip 64 can be wider than the width of the groove 26 for increased strength and received on blade recess edges 68 in the housing body 16. This feature helps prevent the blade tip 64 from engaging and shearing the screw 66 upon hitting a hard surface in the target. While the blade tip 64 is shown in the drawings, it should be kept in mind various types of pointed ends will work equally well in the top of the broadhead 10 for maximum cutting and target penetration. Also, the blade tip 64 can be pressed fit, threaded or glued into the top portion 18 of the housing body 16.

In FIG. 2, a side view of the arrow broadhead 10 is shown. In this drawing, part of the middle portion 22 of the housing body 16 has been cutaway to illustrate a ball spring blade retraction system for holding the blades 42 and 48 in a retracted position. In this example, a spring bore hole 78 is drilled in the side of the housing for receiving a ball 80, a coil spring 82 and a threaded bore hole plug 84. The ball 80 is received in a dimple 86 in the side of the first cutting blade 42 for holding the blade in a retracted position. On the opposite side of the middle portion 22 of the housing 16 is an identical blade retraction system used to hold the second cutting blade 48 in a retracted position. Upon target contact, the bias force of the spring 82 against the ball 80 received in the dimple 86 in the blade 42 is overcome and the cutting blades 42 and 48 move outwardly into an extended position.

Also shown in the drawing is a cutaway section in the top portion 18 of the housing body. In this sectional view, a sliding arm extension retraction system is shown for holding the sliding arm extension 30 in the top of the groove 26 and preventing the arm from sliding downwardly and extending the cutting blades outwardly prior to target contact. The sliding arm extension retraction system also includes a spring bore hole 78 drilled in the side of the housing for receiving a ball 80, a coil spring 82 and a threaded bore hole plug 84. The ball 80 is received in a dimple 86 in the side of the sliding arm extension 30 for holding the arm in place. Upon target contact, the bias force of the spring 82 against the dimple 86 in the sliding arm extension 30 is overcome. The sliding arm extension is then free to move downwardly in the groove 26 for extending the cutting blades 42 and 48 outwardly into an expanded position.

In FIG. 3, another front view of the arrow broadhead 10 is shown and upon target contact. In this drawing, the cutting blades 42 and 48 have been pivoted outwardly from the groove 26 by the sliding arm extension 30 and into an unfolded, expanded position for maximum cutting and target penetration. In this expanded position, an inside blade notch 77 is shown in the cutting blades 42 and 48 for receiving the blade hook 60 and holding the cutting blades in an extended and locked position.

In operation, when the blade tip 64 moves through the target 14, the first and second ends 32 and 34 of the sliding arm extension 30 and a portion of the upper end of the cutting blades 42 and 48 also contact the target 36. At the same time, the sliding arm extension 30 moves downwardly in the groove 26, from the top portion 18 of the housing body 16 to the groove bottom 28. As the sliding arm extension 30 moves downwardly in the groove 26, the cam surface 52 engages and slides along opposite ends of the groove bottom 28, thereby moving the cutting blades 42 and 48 into an expanded position for maximum target engagement.

Figure 4:
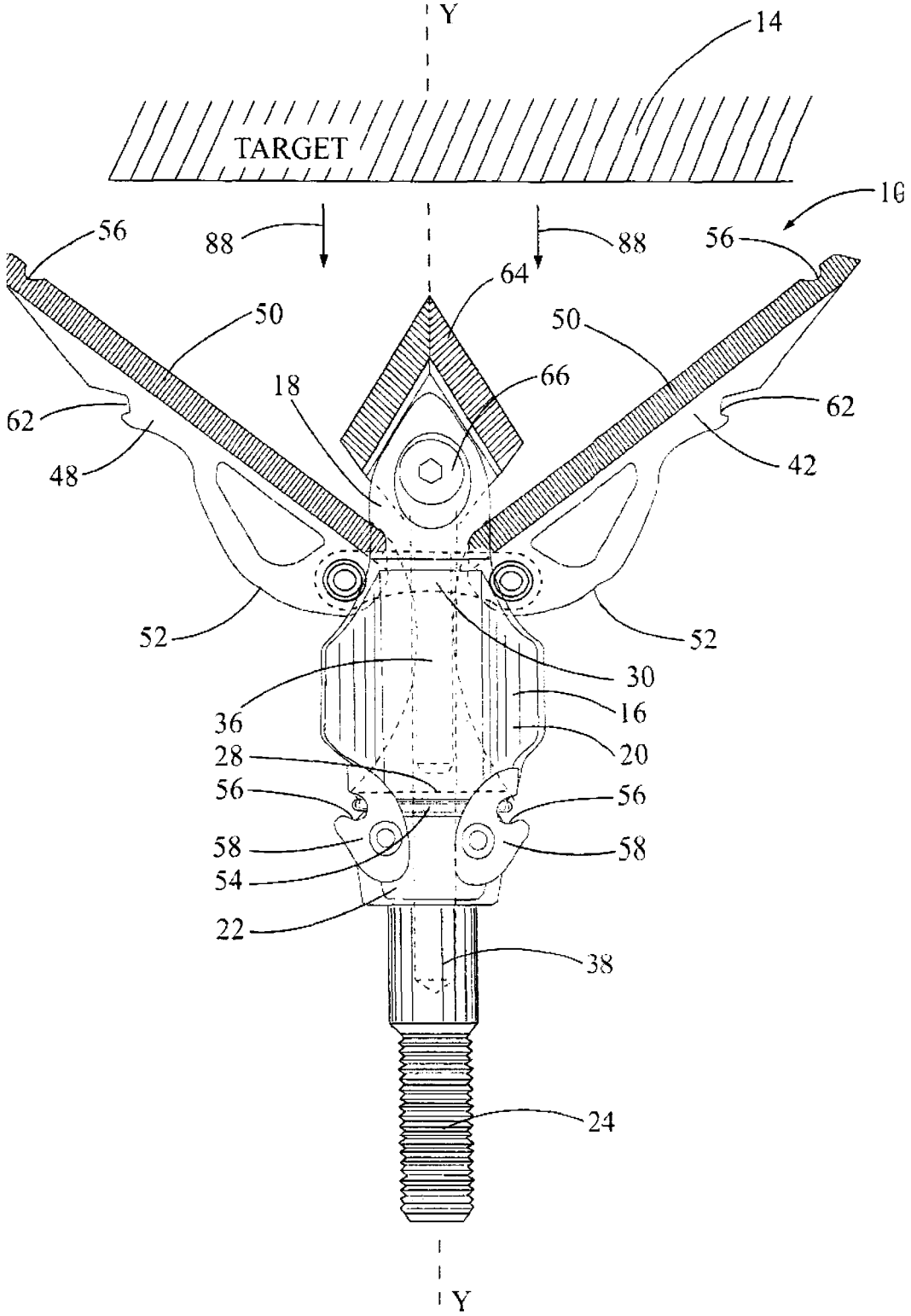
FIG. 4 is still another front view of the broadhead, as shown in FIG. 1, with the cutting blades pulled rearwardly and pointing forwardly for releasing the broadhead from the target and making the broadhead a non-barbed design.

In FIG. 4, another front view of the broadhead 10 is shown with the cutting blades 42 and 48 folded forward, as indicated by arrows 88, for releasing the broadhead 10 from the target 14. In this example and when the broadhead 10 is pulled rearwardly, as indicated by arrows 88, the broadhead provides for a non-barbed design.

Figure 5:
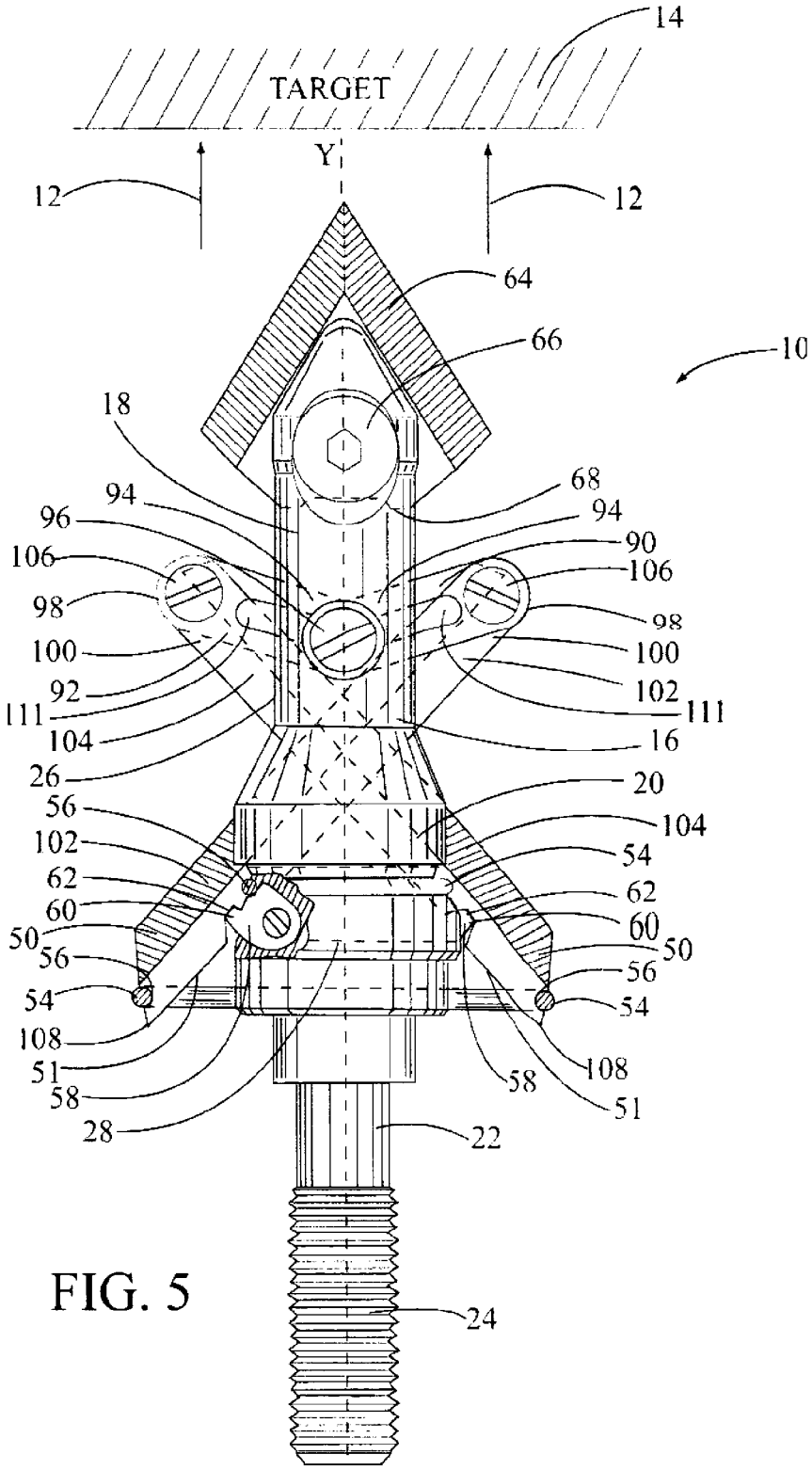
FIG. 5 is a front view of another embodiment of the arrow broadhead with pivot arms and cutting blades held in a folded, retracted position in the elongated groove along the length of a cutting blade housing body during arrow flight and prior to target contact.

In FIG. 5, a front view of another embodiment of the arrow broadhead 10 is shown. This broadhead is similar to the broadhead shown in FIGS. 1-4 and with a housing body 16, top, middle and bottom portions 18, 20, 22, a threaded end 24, and the elongated groove 26 with a groove bottom 28 in the bottom portion 22 of the housing body 16.

In this embodiment, the broadhead 10 includes a first pivot arm 90 and a second pivot arm 92. The first pivot arm 90 includes a first end 94 received in the groove 26 and pinned therein using a threaded screw 96 or similar fastener attached to the housing body 16. The second pivot arm 92 includes a first end 94 also received in the groove 26 and pinned to the threaded screw 96. A second end 98 of the pivot arms 90 and 92 extends outwardly from opposite sides of the groove 26 and are attached to an end of a first cutting blade 102 and a second cutting blade 104 using a rivet 106, screw, or similar fastener. The cutting blades include a beveled cutting edge 50. The cutting blades 102 and 104 extend downwardly into the groove 26 crossing each other in an "X" shaped configuration. A second end 108 of the cutting blades 102 and 104 extend outwardly from the groove 26 with an inner edge 51 of the blades resting on the opposite ends of the groove bottom 28. The second ends 108 of the cutting blades include an "O" ring notch 56 for receiving an "O" ring 54 or similar blade retainer to hold the blades in a retracted position during arrow flight. The pivot arms 90 and 92 can include elongated grooves 111 therein for sliding on a portion of the threaded screw 96 or an alignment pin attached to the housing body 16.

Figure 6:
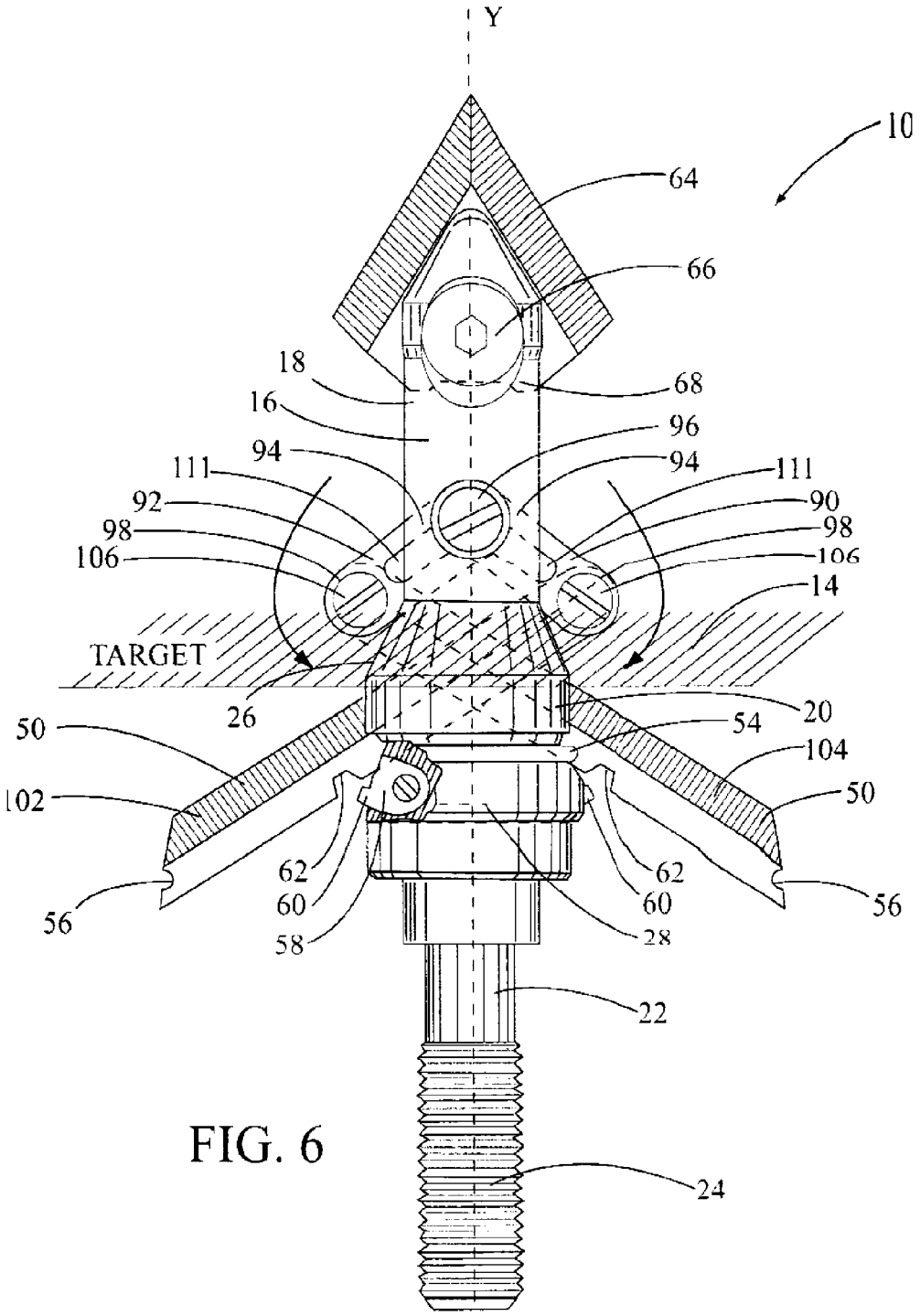
FIG. 6 is another front view of the arrow broadhead, as shown in FIG. 5, with the cutting blades expanded outwardly from the groove by the pivot arms and into an unfolded, expanded position for maximum cutting and target penetration.

In FIG. 6, another front view of the arrow broadhead 10, as illustrated in FIG. 5, is shown and upon target contact. In this drawing, the cutting blades 102 and 104 have been pivoted outwardly from the groove 26 by the pivot arms 90 and 92.

In operation, when the blade tip 64 moves through the target 14, the second ends 98 of the pivot arms 90 and 92 contact the target 14. At the same time, the pivot arms 90 and 92 move downwardly and pivot the attached cutting blades 102 and 104, in a scissor-like fashion, moving the blades outwardly from the groove, into a fully expanded position for maximum target penetration.

Figure 7:
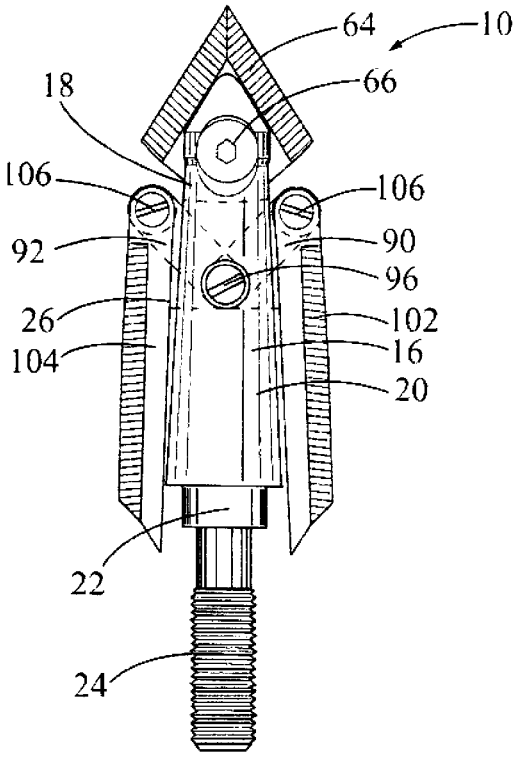
FIGS. 7 and 8 illustrate another embodiment of the arrow broadhead with a pair of pivot arms attached to a pair of cutting blades disposed next to opposite sides of the broadhead's housing body.
Figure 8:
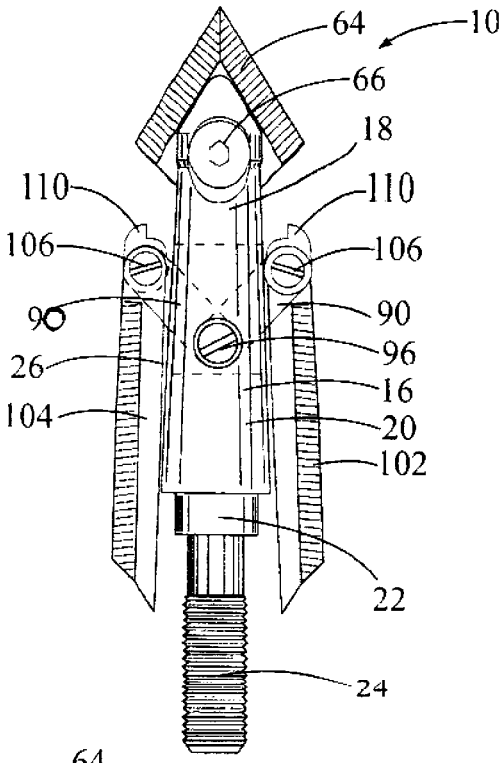

In FIGS. 7 and 8, another embodiment of the arrow broadhead 10 is illustrated with the first and second pivot arms 90 and 92 received in the groove 26 in the housing body 16. In this example, the first and second cutting blades 102 and 104 are received in a portion of the housing body, and disposed folded next to and extending downwardly along a length of the exterior of housing body. In FIG. 8, the top of the cutting blades 102 and 104 include an upper blade hook 110 and a lower blade hook 111. Also attached to the housing body are a pair of cam pins 124.

Figure 9:
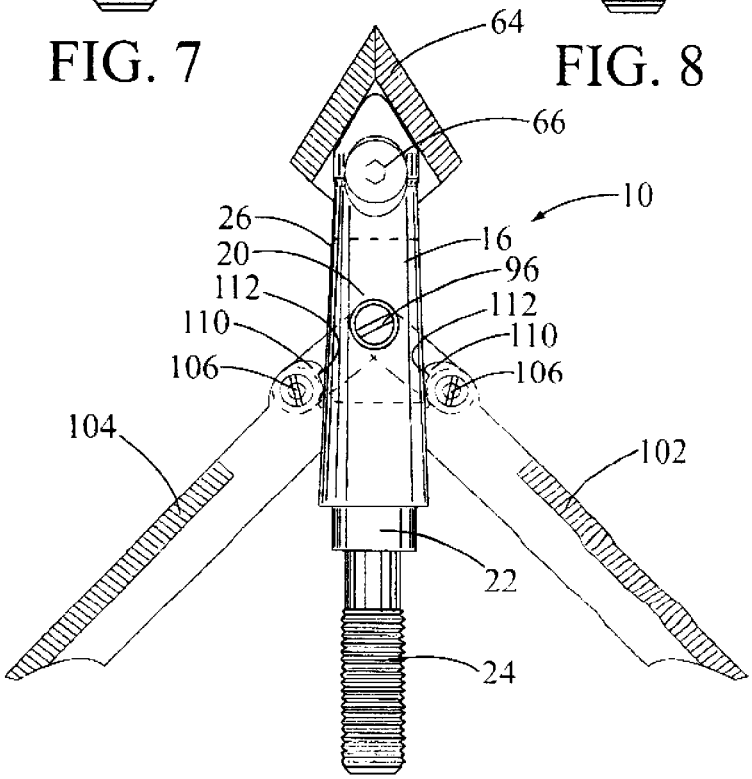
FIG. 9 illustrates the arrow broadhead, shown in FIG. 8, with the cutting blades in an expanded and locked position upon target contact.

In FIG. 9, the broadhead 10, as shown in FIG. 8, illustrates the first and second pivot arms 90 and 92 pivoted downwardly, when contacting the target. At this time, the inner cam surface of the first and second cutting blades 102, 104 ride against the cam pins 124, moving and pivoting the cutting blades outwardly into an expanded position and the upper blade hook 110 engages and hooks over the cam pins 124 locking the blades into an extended and locked position for maximum cutting and target penetration.

Figure 10:
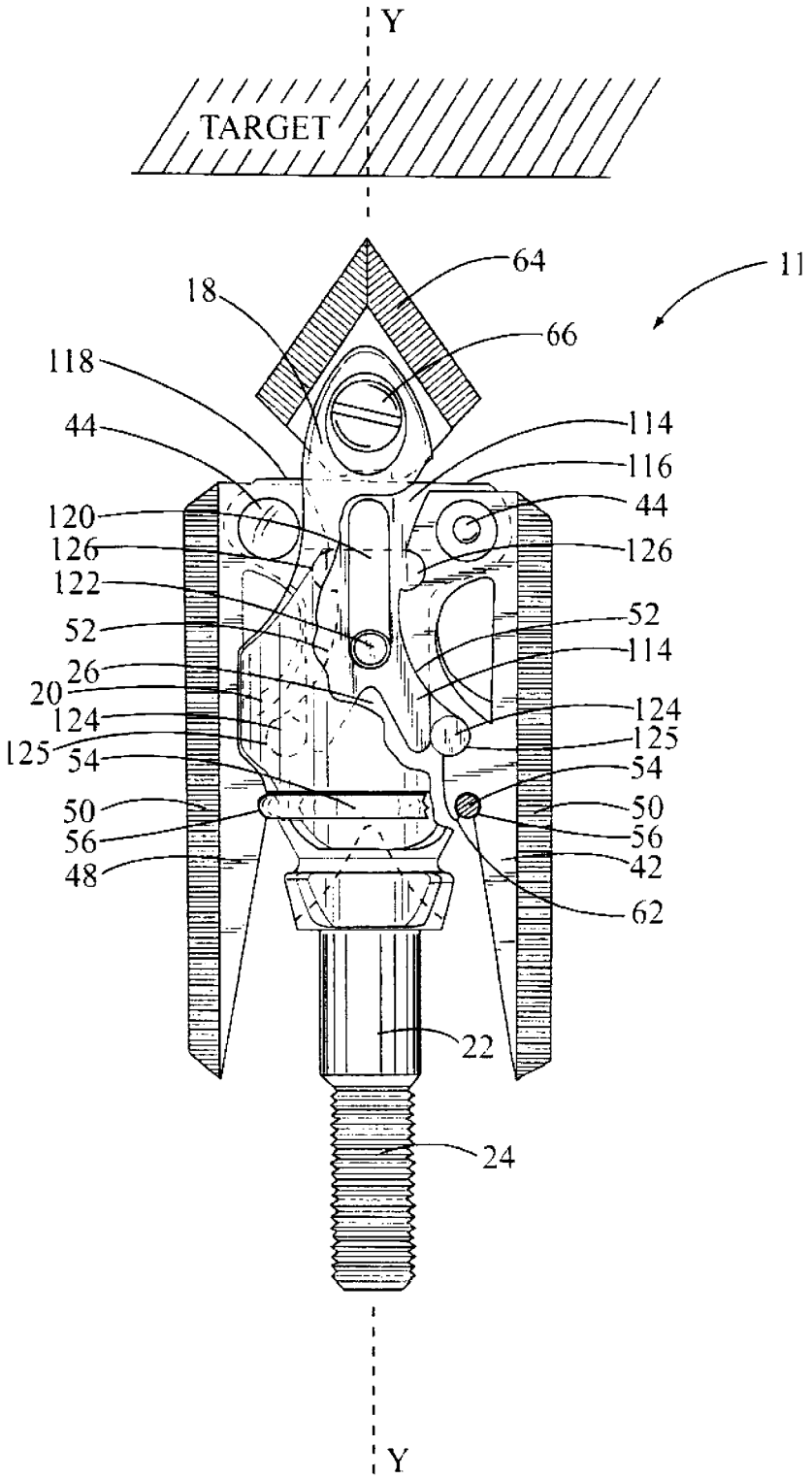
FIG. 10 illustrates a front view of another embodiment of the arrow broadhead, similar to the broadhead shown in FIG. 1, but with a pair of cutting blades attached to opposite arms of a sliding arm plate. The sliding arm plate is received inside the top portion of the elongated groove in the cutting blade housing body. The sliding arm plate is used to pivot the cutting blades from a retracted position to an expanded position.

In FIG. 10, a front view of still another embodiment of the arrow broadhead 10 is shown and similar to the broadhead, shown in FIG. 1, but having a sliding arm plate 114 received inside the groove 26 in the housing body 16. A portion of the housing body 16 has been cutaway to illustrate the sliding arm plate 114 inside the groove 26 in the housing body 16. In this example, the first cutting blade 42 is pivotally attached to a first plate arm extension 116 and the second cutting blade 48 is pivotally attached to a second plate arm extension 118, using rivets 44, or screws or similar fasteners. The plate arm extensions 116 and 118 extend outwardly from the sides of the sliding arm plate 114.

For providing proper alignment of the sliding arm plate 114, the plate includes an elongated plate groove 120. A groove alignment pin 122 is attached to the housing body 16 and is received through a portion of the plate groove 120. Also attached to opposite sides of the middle portion 20 of the housing body 16 are a pair of cam pins 124. The pair of cam pins 124 are on the outer side edges of the sliding arm plate 114 and also work as an alignment device as the sliding arm plate 114 moves downwardly. The cam pins 124 are disposed next to a portion of the inner cam surface 52 of the cutting blades 42 and 48. Also shown in this drawing is an alignment pin notch 125 in the cutting blades 42 and 48 that hook over the alignment pins 124. The cutting blades 42 and 48 have a hook portion 62 where the "O" ring 54 holds the cutting blades in a retracted position during arrow flight. Further shown in this drawing is the "O" ring 54 held in the "O" ring notch 56 in the cutting blades 42 and 48 for holding the cutting blades in a retracted position.

Figure 11:
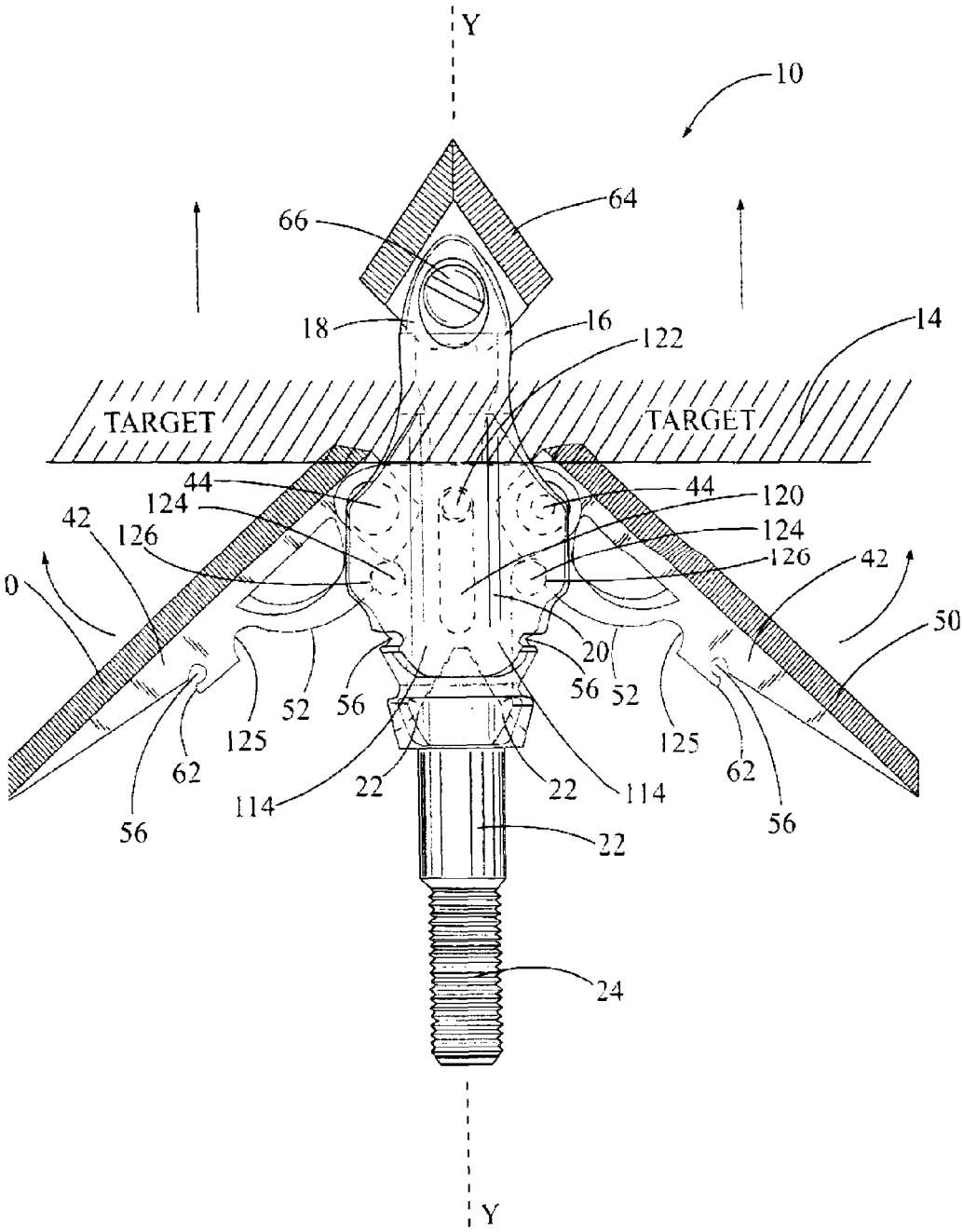
FIG. 11 is another front view of the broadhead, as shown in FIG. 10, with the sliding arm plate moved from the top portion of the groove downwardly to a bottom of the groove upon target contact. The sliding arm plate has now pivoted the cutting blades outwardly into an expanded position for maximum cutting and target penetration.

In FIG. 11, another front view of the broadhead 10, as viewed in FIG. 10, is shown with the sliding arm plate 114 moved from the top portion of the groove 16 downwardly to the bottom portion of the groove upon target contact by the first and second plate arm extensions 116 and 118 and the cutting blades 42 and 48. The sliding arm plate 114 is held in alignment between the pair of cam pins 124 as the plate groove 120 slides past the groove alignment pin 122. As the sliding arm plate 114 moves downwardly, the inner cam surface 52 of the cutting blades 42 and 48 ride against the cam pins 124 moving the cutting blades outwardly into an expanded position and inner blade notch 126 of the cutting blades 42 and 48 hook over the cam pins 124 locking the blades into an extend and locked position, for maximum cutting and target penetration. Also at this time and as the cutting blades 42 and 48 move outwardly, the "O" ring 54 is stretched and is released from the hook portion 62 on the cutting blades and pushed or moved from the upper "O" ring notch 56 downwardly into a lower "O" ring notch.

It should be mentioned that the various blade retention means shown in the drawings for holding the cutting blades in a retracted position during arrow flight can be used equally well for the other embodiments of the broadhead disclosed herein.

While the invention has been particularly shown, described and illustrated in detail with reference to various exemplary embodiments and modifications thereof, it should be understood by those skilled in the art that equivalent changes in form and detail may be made without departing from the true spirit and scope of the present disclosure.

What is claimed is:

1. An arrow broadhead comprising:

a housing body having at least one elongated aperture extending through at least a portion of the housing body;

a tip coupled to the housing body;

at least one elongated generally cylindrical arm disposed at least partially within the elongated aperture and rearward of the tip, the at least one arm configured to move independently from the tip; and first and second cutting blades disposed at least partially within the elongated aperture and pivotally coupled to the at least one arm;

wherein the first and second cutting blades are configured to pivot outward relative to the housing body as the at least one arm moves rearward relative to the housing body within the elongated aperture;

wherein the first and second cutting blades each have a cutting edge and an inside edge, each inside edge having a protruding portion extending from the cutting blade.

2. The arrow broadhead of claim 1, wherein the at least one arm is pivotally coupled to the housing body.

3. The arrow broadhead of claim 1, wherein the at least one arm is configured to slide rearward within the elongated aperture in the housing body.

4. The arrow broadhead of claim 1, wherein the at least one arm comprises a pair of moveable arms disposed at least partially within the elongated aperture in the housing body.

5. The arrow broadhead of claim 1, wherein each cutting blade defines an elongated window therethrough.

6. The arrow broadhead of claim 1, wherein, at least in a retracted position, the first cutting blade extends through a first side of the aperture and protrudes out a second, opposite side of the aperture.

7. The arrow broadhead of claim 1, wherein the tip comprises a blade.

8. The arrow broadhead of claim 1, wherein a cutting blade has a recess configured to receive a curved portion of a spring mechanism.

9. The arrow broadhead of claim 1, wherein, at least in a retracted position, the first cutting blade extends through a first side of the aperture and protrudes out a second, opposite side of the aperture.

10. The arrow broadhead of claim 1, wherein the tip comprises a cutting blade.

11. The arrow broadhead of claim 1, wherein the tip is at least one of press fit, glued or threaded into a portion of the housing body.

12. An arrow broadhead comprising:

a housing body having at least one elongated aperture extending through at least a portion of the housing body;

a tip coupled to the housing body;

at least one elongated generally cylindrical arm disposed at least partially within the elongated aperture and rearward of the tip, the at least one arm configured to move independently from the tip; and first and second cutting blades disposed at least partially within the elongated aperture and pivotally coupled to the at least one arm;

wherein the first and second cutting blades are configured to pivot outward relative to the housing body as the at least one arm moves rearward relative to the housing body within the elongated aperture, wherein at least one of the first and second cutting blades has a recess configured to receive a curved portion of a spring mechanism for retaining the at least one cutting blade in a retracted position.

13. The arrow broadhead of claim 12, wherein the first and second cutting blades each have a cutting edge and an inside edge, each inside edge having a protruding portion extending from the cutting blade.

14. The arrow broadhead of claim 13, wherein each cutting blade defines an elongated window therethrough.

15. The arrow broadhead of claim 14, wherein, at least in a retracted position, the first cutting blade extends through a first side of the aperture and protrudes out a second, opposite side of the aperture.

16. The arrow broadhead of claim 12, wherein the tip comprises a blade.

17. An arrow broadhead, comprising:

a housing body having at least one elongated aperture extending through at least a portion of the housing body;

at least one elongated generally cylindrical arm disposed at least partially within the elongated aperture; and first and second cutting blades pivotally coupled to the at least one arm, wherein at least a portion of each of the first and second cutting blades is exposed outside the housing body in a retracted position, wherein the first and second cutting blades are configured to pivot outward relative to the housing body from the retracted position to an extended position as the at least one arm moves rearward relative to the housing body within the elongated aperture.

18. The arrow broadhead of claim 17, further comprising:

a tip coupled to the housing body;

wherein the at least one elongated generally cylindrical arm is disposed rearward of the tip, the at least one arm configured to move independently from the tip;

wherein the first and second cutting blades are disposed at least partially within the elongated aperture; and an O-shaped metal ring configured to hold the at least one arm or at least one of the first and second cutting blades in a retracted position.

19. The arrow broadhead of claim 18, wherein, at least in the retracted position, the first cutting blade extends through a first side of the aperture and protrudes out a second, opposite side of the aperture.

20. The arrow broadhead of claim 19, wherein the tip is removable.

* * * * *

US008771112C1

(12) EX PARTE REEXAMINATION CERTIFICATE (27th)

Ex Parte Reexamination Ordered under 35 U.S.C. 257

United States Patent

Sanford

(10) Number: US 8,771,112 C1

(45) **Certificate Issued: *Apr. 15, 2015**

(54) BROADHEAD

(71) Applicant: Chris G. Sanford, Billings, MT (US)

(72) Inventor: Chris G. Sanford, Billings, MT (US)

Supplemental Examination Request:
No. 96/000,073, Aug. 19, 2014

Reexamination Certificate for:

| | |
|---|---|
| Patent No.: | **8,771,112** |
| Issued: | **Jul. 8, 2014** |
| Appl. No.: | **13/664,196** |
| Filed: | **Oct. 30, 2012** |

( * ) Notice: This patent is subject to a terminal disclaimer.

Related U.S. Application Data

(60) Continuation of application No. 13/363,284, filed on Jan. 31, 2012, now Pat. No. 8,313,399, which is a continuation-in-part of application No. 12/590,393, filed on Nov. 5, 2009, now Pat. No. 8,105,187, which is a continuation-in-part of application No. 11/810,285, filed on Jun. 5, 2007, now Pat. No. 8,007,382, said application No. 13/363,284 is a continuation-in-part of application No. 13/374,340, filed on Dec. 23, 2011, now Pat. No. 8,287,407, which is a division of application No. 12/590,393, which is a continuation-in-part of application No. 11/810,285, said application No. 13/363,284 is a continuation-in-part of application No. 13/374,549, filed on Jan. 3, 2012, now Pat. No. 8,393,983, which is a continuation-in-part of application No. 12/590,393, which is a continuation-in-part of application No. 11/810,285.

(51) Int. Cl.
*F42B 6/08* (2006.01)

(52) U.S. Cl.
CPC ..... *F42B 6/08* (2013.01)

(58) Field of Classification Search
None
See application file for complete search history.

(56) References Cited

To view the complete listing of prior art documents cited during the supplemental examination proceeding and the resulting reexamination proceeding for Control Number 96/000,073, please refer to the USPTO's public Patent Application Information Retrieval (PAIR) system under the Display References tab.

*Primary Examiner* — William Doerrler

(57) ABSTRACT

An arrow broadhead having a pair of cutting blades held in a retracted position during arrow flight and extending outwardly in an expanded position upon arrow contact. The subject broadhead includes a pair of pivot arms or sliding arm received in an elongated groove in a cutting blade housing body. The pivot arms or sliding arm are attached to one end of the cutting blades. At least a portion of the cutting blades are folded into the groove during arrow flight. Upon target contact, the pivot arms or sliding arm pivot the cutting blades outwardly from opposite sides of the groove into an expanded position for increased cutting and penetration in the target.

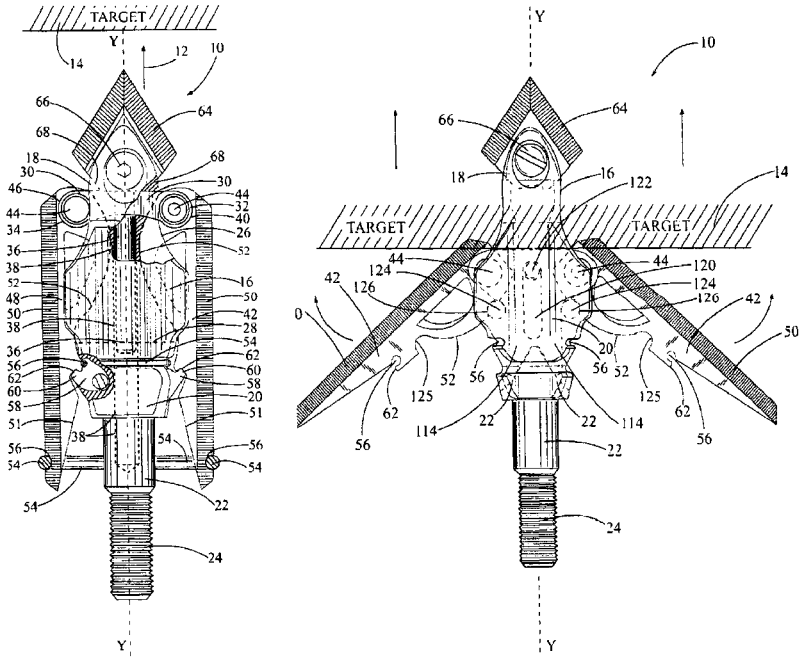

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6, 7, 9 and 20 are cancelled.

Claims 1, 12, 17 and 18 are determined to be patentable as amended.

New claims 21-34 are added and determined to be patentable.

Claims 2-5, 8, 10, 11, 13-16 and 19 were not reexamined.

1. An arrow broadhead comprising:

a housing body having at least one elongated aperture extending through at least a portion of the housing body;

a tip coupled to the housing body;

at least one elongated generally cylindrical arm disposed at least partially within the elongated aperture and rearward of the tip, the at least one arm configured to move independently from the tip; and first and second cutting blades disposed at least partially within the elongated aperture and pivotally coupled to the at least one arm;

wherein the first and second cutting blades are configured to pivot outward relative to the housing body as the at least one arm moves rearward relative to the housing body within the elongated aperture;

wherein the first and second cutting blades each have a cutting edge and an inside edge, each inside edge having a protruding portion extending from the cutting blade,

*wherein, at least in a retracted position, the first cutting blade extends through a first side of the aperture and protrudes out a second, opposite side of the aperture.*

12. An arrow broadhead comprising:

a housing body having at least one elongated aperture extending through at least a portion of the housing body;

a tip coupled to the housing body;

at least one elongated generally cylindrical arm disposed at least partially within the elongated aperture and rearward of the tip, the at least one arm configured to move independently from the tip; and first and second cutting blades disposed at least partially within the elongated aperture and pivotally coupled to the at least one arm;

*wherein the first and second cutting blades each have an impact portion and a cutting portion, the impact portion configured to contact a target and the impact portion to be actuated by the target to move the at least one arm rearward,* wherein the first and second cutting blades are configured to pivot outward relative to the housing body as the at least one arm moves rearward relative to the housing body within the elongated aperture, wherein at least one of the first and second cutting blades has a recess configured to receive a curved portion of a spring mechanism for retaining the at least one cutting blade in a retracted position.

17. An arrow broadhead, comprising:

a housing body having at least one elongated aperture extending through at least a portion of the housing body;

at least one elongated generally cylindrical arm disposed at least partially within the elongated aperture, *the arm comprising a shaft integral in one piece with a tip, the tip having a tip base and an integral tip point*; and first and second cutting blades pivotally coupled to the [at least one arm] *tip base*, wherein at least a portion of each of the first and second cutting blades is exposed outside the housing body in a retracted position, wherein the first and second cutting blades [are] *each comprise a camming surface* configured to *cam against another surface of the arrow broadhead and* pivot outward relative to the housing body from the retracted position to an extended position as the at least one arm moves rearward relative to the housing body within the elongated aperture.

18. The arrow broadhead of claim 17, [further comprising:

a tip coupled to the housing body;

wherein the at least one elongated generally cylindrical arm is disposed rearward of the tip, the at least one arm configured to move independently from the tip;]

wherein the first and second cutting blades are disposed at least partially within the elongated aperture; and an O-shaped metal ring configured to hold the at least one arm or at least one of the first and second cutting blades in a retracted position.

*21. The arrow broadhead of claim 17, wherein the housing body comprises a lower end for threaded attachment to an arrow shaft, wherein the elongated aperture has an inner wall in contact with a lowest portion of the arm in both the retracted and extended positions of the blades.*

*22. The arrow broadhead of claim 17, wherein the first and second cutting blades each comprise a camming surface having a straight portion, each straight camming surface portion riding against a camming member as the first and second cutting blades pivot from the retracted position to an extended position.*

*23. The arrow broadhead of claim 22, wherein the entire camming surface is straight.*

*24. The arrow broadhead of claim 17, wherein the shaft has a lower end portion opposite the tip, the lower end portion being solid.*

*25. The arrow broadhead of claim 17, wherein an outside portion of the tip point has a recessed portion.*

*26. The arrow broadhead of claim 17, wherein a rear portion of the tip is solid.*

*27. The arrow broadhead of claim 17, wherein the tip base has an outer diameter which is greater than an outer diameter of the shaft.*

*28. An arrow broadhead, comprising:*

*a housing body having at least one elongated aperture extending through at least a portion of the housing body;*

*at least one elongated generally cylindrical arm disposed at least partially within the elongated aperture; and*

*first and second cutting blades pivotally coupled to the at least one arm, wherein at least a portion of each of the first and second cutting blades is exposed outside the housing body in a retracted position, wherein the first and second cutting blades are configured to pivot outward relative to the housing body from the retracted position to an extended position as the at least one arm moves rearward relative to the housing body within the elongated aperture;*

*wherein the housing body comprises a lower end for threaded attachment to an arrow shaft, wherein the elon-*

*gated aperture has an inner wall in contact with a lowest portion of the arm in both the retracted and extended positions of the blades.*

*29. The arrow broadhead of claim 28, the arm further comprising a tip, the tip having a tip base and a tip point.*

*30. The arrow broadhead of claim 29, wherein the first and second cutting blades each comprise a camming surface having a straight portion, each straight camming surface portion riding against a camming member as the first and second cutting blades pivot from the retracted position to an extended position.*

*31. The arrow broadhead of claim 30, wherein the arm has a lower end portion opposite the tip, the lower end portion being solid.*

*32. The arrow broadhead of claim 31, wherein an outside portion of the tip point has a recessed portion.*

*33. The arrow broadhead of claim 32, wherein a rear portion of the tip is solid.*

*34. The arrow broadhead of claim 33, wherein the entire camming surface is straight.*

* * * * *